US010098185B2

(12) United States Patent
Nilsson

(10) Patent No.: US 10,098,185 B2
(45) Date of Patent: Oct. 9, 2018

(54) POWER CONTROLLED HEATING SYSTEM

(71) Applicant: KIMA HEATING CABLE AB, Hassleholm (SE)

(72) Inventor: Jan Anders Nilsson, Vinslov (SE)

(73) Assignee: KIMA HEATING CABLE AB, Hässleholm (SE)

( * ) Notice: Subject to any disclaimer, the term of this patent is extended or adjusted under 35 U.S.C. 154(b) by 367 days.

(21) Appl. No.: 14/786,848

(22) PCT Filed: Apr. 15, 2014

(86) PCT No.: PCT/EP2014/057645
§ 371 (c)(1),
(2) Date: Oct. 23, 2015

(87) PCT Pub. No.: WO2014/173737
PCT Pub. Date: Oct. 30, 2014

(65) Prior Publication Data

US 2016/0081140 A1 Mar. 17, 2016

(30) Foreign Application Priority Data

Apr. 23, 2013 (SE) ..... 1350500

(51) Int. Cl.
*H05B 1/02* (2006.01)
*H05B 3/34* (2006.01)
*H05B 3/56* (2006.01)

(52) U.S. Cl.
CPC ..... *H05B 3/34* (2013.01); *H05B 1/0202* (2013.01); *H05B 3/56* (2013.01); *H05B 2203/017* (2013.01)

(58) Field of Classification Search
CPC ..... H05B 3/34; H05B 1/0202; H05B 3/56; H05B 2203/007; H05B 2203/017; H05B 3/36; H05B 3/026
(Continued)

(56) References Cited

U.S. PATENT DOCUMENTS 2,724,663 A * 11/1955 Bond ..... C23C 14/26 118/726
3,757,086 A * 9/1973 Indoe ..... H05B 3/56 219/528
(Continued)

FOREIGN PATENT DOCUMENTS

EP 0227405 7/1987
FR 86378 1/1966
(Continued)

OTHER PUBLICATIONS

International Search Report for PCT/EP2014/057645, Completed by the European Patent Office on Jul. 4, 2014, 4 Pages.

*Primary Examiner* — Mark Paschall
(74) *Attorney, Agent, or Firm* — Christensen O'Connor Johnson Kindness PLLC

(57) ABSTRACT

A method for heating an object, where the method includes the steps of choosing one or more elongated heating member or members, adapting one or more elongated heating member or members to form an elongated combined heating member having a length within a predetermined length interval and providing a predetermined constant current through the elongated combined heating member by connecting a constant current source to a first end and a second end of the elongated combined heating member, such that the combined heating member generating a power per unit length when the constant current flowing through the combined heating member between the first end and the second end. A device for heating an object and a kit of parts for assembling such a heating device is also disclosed.

24 Claims, 5 Drawing Sheets

(58) Field of Classification Search
USPC ..... 219/497, 212, 213, 483–465, 537, 539, 219/546, 549
See application file for complete search history.

(56) References Cited

U.S. PATENT DOCUMENTS

| | | | | |
|---|---|---|---|---|
| 3,784,784 | A * | 1/1974 | Geominy | H05B 3/56 219/222 |
| 3,859,506 | A | 1/1975 | Weckstein | |
| 4,319,078 | A * | 3/1982 | Yokoo | G06F 3/045 178/18.05 |
| 4,849,611 | A | 7/1989 | Whitney et al. | |
| 5,369,247 | A | 11/1994 | Doljack | |
| 7,071,446 | B1 * | 7/2006 | Bench | E04D 13/103 219/211 |
| 2003/0052121 | A1 | 3/2003 | Sopory | |
| 2007/0175879 | A1 * | 8/2007 | Jones | F24D 13/02 219/213 |
| 2007/0193747 | A1 | 8/2007 | De St. Remey et al. | |
| 2009/0238547 | A1 * | 9/2009 | Borgmeier | F16L 53/008 392/465 |

FOREIGN PATENT DOCUMENTS

| | | |
|---|---|---|
| SE | 530576 | 7/2008 |
| WO | 0025069 | 5/2000 |
| WO | 2006072765 | 7/2006 |

* cited by examiner

POWER CONTROLLED HEATING SYSTEM

CROSS-REFERENCE TO RELATED APPLICATION

This application is the U.S. national phase of PCT Application No. PCT/EP2014/057645 filed on Apr. 15, 2014, which claims priority to SE Patent Application No. 1350500-3 filed on Apr. 23, 2013, the disclosures of which are incorporated in their entirety by reference herein.

TECHNICAL FIELD OF THE INVENTION

The present invention relates to a method for heating an object, a corresponding heating device, and a corresponding kit of parts. In particular, the present invention relates to a power controlled heating method.

BACKGROUND

In order to heat an environment or an object, different heating elements may be used. There are many forms of heating elements including water heaters, gas heaters, pressure heaters and electrical heaters.

For electrical heaters, the heating element commonly comprises a conductor over which a suitable voltage is applied. Consequently, a current flows through the conductor. The current is related to the voltage according to Ohm's law: $U=R\cdot I$, wherein U is the provided voltage, I is the current and R is the total resistance of the heating element. The resulting power output which corresponds to an increased temperature of the heating element and thus, its surrounding environment, may be formulated as $P=U\cdot I=R\cdot I^2$.

A common electrical heater is a heating cable comprising one or more electrical conductors. The total resistance of a heating cable is dependent on how the heating cable is constructed and also on the length of the heating cable. A shorter length results in a lower resistance and consequently a higher current under the condition that the voltage is kept relatively constant. As a consequence, the power output per unit length will increase with decreasing length and potentially reach dangerous levels. However, when arranging a heating cable, or any other elongated heating element, to a installation site, it is advantageously if the heating cable may be cut to a certain length.

For this problem, there are a number of known solutions. Parallel resistive heating cables, as for example disclosed in patent application U.S. Pat. No. 3,859,506, are designed for being cut to a length on an installation site for a specific application. In reality, this means that a parallel resistive cable is purchased as one very long cable and thereafter cut to length at convenience. This quality has made the parallel resistive cable an increasingly popular alternative to the commonly used series resistive cables which is not designed to be cut-to-length. Series resistive cable are instead provided with a fixed length which must be estimated from the intended application and specified on beforehand.

While a parallel resistive cable has advantages over a series resistive cable regarding the above mentioned quality, it has drawbacks regarding other qualities. Due to its construction, the parallel resistive cable is an expensive cable and is not as mechanically strong as a series resistive cable. Furthermore, a parallel resistive cable is generally limited in that it should have a length in the range of about 50-130 meters.

With heating cables having a long length, there is furthermore a risk of very high starting currents when a voltage is applied, in particular when the surrounding, and consequently the cable, has a low temperature. Therefore fuses with high rated current must be used, thus leaving the security questionable.

In order to overcome the risk of very high currents, the current may be set to a constant value, as disclosed in patent application U.S. Pat. No. 4,849,611. The application describes a heating cable comprising a resistive heating component and a temperature-sensitive component. The heater may be provided with a constant current or a constant voltage. However, the longer a heating element according to U.S. Pat. No. 4,849,611 is, the higher the required voltage will be since the current is kept constant. Thus, the security is still left questionable. Furthermore, an installation of such a cable cut-to-length for a specific application would be complex since the means for providing the required voltage would also need to be adapted to the specific application, i.e. be transformed from, e.g., a mains voltage into the required voltage which could differ several hundred volts. Thus, the installation would not only be complex but also costly.

It is desirable to overcome or reduce the above mentioned drawbacks while still retaining a possibility to adapt the length of the heating element at its installation site to a specific length required by a specific application.

SUMMARY OF THE INVENTION

A general object of the present invention is to alleviate the above mentioned drawbacks. A further object of the present invention is to provide heating of an object in a simple and cost-efficient way.

The inventor of the present invention has realized that the above mentioned and other drawbacks of known techniques may be alleviated by providing the possibility to choose a heating member, i.e. conductor, with a specific resistance per unit length which in combination with a predetermined constant current requires a voltage within a defined voltage interval when the length of the heating member lies within a predetermined length interval.

A plurality of different heating members designed to operate within different length intervals may be provided such that a user can choose a suitable heating member based on an approximation of the required heating member length for a specific application. The user can adapt the heating cable length to any length within the interval and is ensured that the required voltage lies within a known voltage interval, provided that the current is kept to a constant predetermined value.

Furthermore, the user is ensured that the output power per unit length of the heating member is constant since the current is constant. Thereby both the complexity drawback of resulting in a too high or low voltage level and the security risk of the increased power output per unit length for a short heating member is alleviated.

Furthermore, the user does not need to purchase heating cables, or other similar heating elements, with fixed lengths provided for a specific installation site. The user can instead adapt a heating member in a heating cable, at any installation site, within the predetermined length interval associated with the particular heating member and its resistance. Hence, a much more flexible and secure solution is provided in comparison to known techniques.

Applications for the present inventions can be found in a wide range of areas, including floor heating, snow melting, frost protection, pool heating, pipe heating, heating of commercial and domestic appliances, heating of devices, compensation for heat losses, tempering/curing of glue/glass/plastics, hardening of concrete, etc. Further, in process industry the present invention may be used to heat pipes and consequently any material present in the pipes. This means that the present invention may be used to heat for instance liquids flowing within the pipes being heated.

According to a first aspect of the invention the above mentioned and other objects are accomplished through a method for heating an object. The method comprises the steps of: choosing one or more elongated heating member or members, the one or more heating member or members having a predetermined resistance per unit length; adapting the one or more elongated heating member or members to form an elongated combined heating member having a length within a predetermined length interval, wherein the predetermined length interval is dependent upon the choice of the one or more elongated heating member or members; and providing a predetermined constant current through the elongated combined heating member by connecting a means for generating a constant current to a first end and a second end of the elongated combined heating member, such that the combined heating member is generating a power per unit length when the constant current flowing through the combined heating member between the first end and the second end. The one or more elongated heating member or members having the predetermined resistance per unit length is/are chosen such that a voltage required for maintaining the predetermined constant current lies within a predetermined voltage interval for every possible length of the combined heating member within the predetermined length interval.

Advantageously, the combined heating member is comprised in a heating cable or a heating foil. The combined heating member may also be included in other heating elements such as a radiator or a heating plate.

A plurality of heating members having different resistances per unit length may be comprised in a heating cable or a heating foil, which is advantageous in that the heating cable or heating foil may be associated with a plurality of predetermined length intervals.

It is advantageous if the combined heating member is a series resistive heating member, in particular a series resistive heating cable.

The combined heating member may comprise a material with specific characteristics for conducting electricity. Such materials are, e.g., aluminium, iron, nickel, chrome, cobalt, manganese, zinc, copper, tin, and silicon or an alloy thereof. Advantageous alloys include invar, FeCrAl, constantan, stainless steel, CuNi, NiCr, and brass. In particular, the combined heating member may comprise a conducting element comprising one of the above disclosed materials or alloys.

The combined heating member has preferably a resistivity within the interval 0.0172-1.39 $\Omega mm^2/m$, which is advantageous in that existing commercially available alloys may be used.

The combined heating member may have a predetermined resistance per unit length within the interval of: 0.0008 Ω/m-500 Ω/m. This is advantageous in that existing commercially available alloys and production methods may be used.

According to some currently preferred embodiments of the invention, the predetermined resistance per unit length may be chosen from the interval of: 0.0008 Ω/m-0.1 Ω/m, which is advantageous in that long heating members up to 20000 m may be produced using existing commercially available alloys and production methods According to some currently preferred embodiments of the invention, the predetermined length interval may have a range in the interval of 50-500 meters, in particular a range in the interval of 100-300 meters. By range is meant the length of the interval. For example, the length interval 250-600 meters has a range of 350 meters. The preferred ranges are advantageous in that the required voltage is limited into a preferred interval by them, provided that the current is kept to a predetermined constant value.

It is advantageous to adapt the method such that predetermined voltage interval is one from the group consisting of: 8-230V, 15-400V, 5-110V and 40-1000V. Different voltage intervals may be preferred in different countries or regions depending on the provided standard mains voltage in the particular country/region. For example, in some countries in Europe the standard mains voltage is 230V and in such countries the predetermined voltage interval may be preferred to be an interval below 230V. In particular, the preferred interval may be just below 230V, such as 8V-230V. Correspondingly applies to other countries and regions with other standard voltage mains. For example, the USA has 120V as a standard mains voltage, some countries in Europe have 230V as a standard mains voltage while others in Europe have 240V, Japan has 100V as a standard mains voltage and China has 220V. Limiting the predetermined voltage interval is advantageous in that the required voltage for maintaining the constant current may be provided from the voltage mains without any transformation.

According to a second aspect of the invention the above mentioned and other objects are accomplished through a device for heating an object. The device comprises an elongated combined heating member and means for generating a predetermined constant current. The combined heating member has a resistance per unit length and a length within a predetermined length interval, wherein the predetermined length interval is associated with the resistance per unit length. The means is connected to a first end and a second end of the elongated combined heating member, such that the combined heating member generates a power per unit length when the constant current is arranged to flow through the combined heating member between the first end and the second end. The resistance per unit length is provided such that a voltage required for maintaining the predetermined constant current, when the current flows through the combined heating member between the first end and the second end, is within a predetermined voltage interval for every length within the predetermined length interval.

Advantageously, the combined heating member is comprised in a heating cable or a heating foil. The combined heating member may also be included in other heating elements such as a radiator or a heating plate.

A plurality of heating members having different resistances per unit length may be comprised in a heating cable or a heating foil, which is advantageous in that the heating cable or heating foil may be associated with a plurality of predetermined length intervals.

It is advantageous if the combined heating member is a series resistive heating member, in particular a series resistive heating cable.

The combined heating member may comprise a material with specific characteristics for conducting electricity. Such materials are, e.g., aluminium, iron, nickel, chrome, cobalt, manganese, zinc, copper, tin, and silicon or an alloy thereof. Advantageous alloys include invar, FeCrAl, constantan, stainless steel, CuNi, NiCr, and brass. In particular, the combined heating member may comprise a conducting element comprising one of the above disclosed materials or alloys.

The combined heating member has preferably a resistivity within the interval 0.0172-1.39 $\Omega mm^2/m$, which is advantageous in that existing commercially available alloys may be used.

According to some currently preferred embodiments of the invention, the predetermined length interval may have a range in the interval of 50-500 meters, in particular a range in the interval of 100-300 meters. By range is meant the length of the interval. For example, the length interval 250-600 meters has a range of 350 meters. The preferred ranges are advantageous in that the required voltage is limited into a preferred interval by them, provided that the current is kept to a predetermined constant value.

It is advantageous to adapt the method such that predetermined voltage interval is one from the group consisting of: 8-230V, 15-400V, 5-110V and 40-1000V. Different voltage intervals may be preferred in different countries or regions depending on the provided standard mains voltage in the particular country/region. For example, in some countries in Europe the standard mains voltage is 230V and in such countries the predetermined voltage interval may be preferred to be an interval below 230V. In particular, the preferred interval may be just below 230V, such as 8V-230V. Correspondingly applies to other countries and regions with other standard voltage mains. For example, the USA has 120V as a standard mains voltage, some countries in Europe have 230V as a standard mains voltage while others in Europe have 240V, Japan has 100V as a standard mains voltage and China has 220V. Limiting the predetermined voltage interval is advantageous in that the required voltage for maintaining the constant current may be provided from the voltage mains without any transformation.

The combined heating member may have a predetermined resistance per unit length within the interval of: 0.0008 Ω/m-500 Ω/m. This is advantageous in that existing commercially available alloys and production methods may be used.

According to some currently preferred embodiments of the invention, the predetermined resistance per unit length may be chosen from the interval of: 0.0008 Ω/m-0.1 Ω/m, which is advantageous in that long heating members up to 20000 m may be produced using existing commercially available alloys and production methods According to a third aspect of the invention the above mentioned and other objects are accomplished through a heating mat comprising a device as disclosed above in connection to the second aspect. The combined heating member is distributed on and fastened to a surface of a flexible support member, such that a heating mat is provided. The heating mat generates a power per unit area when the constant current flows through the combined heating member between the first end and the second end.

According to a fourth aspect of the invention the above mentioned and other objects are accomplished through a kit of parts for assembling a heating device comprising a first elongated heating member having a predetermined first resistance per unit length adapted to a predetermined first length interval; a second elongated heating member having a predetermined second resistance per unit length adapted to a predetermined second length interval; and means for generating a predetermined constant current. Each of the first and the second elongated heating member with the predetermined first resistance per unit length and the predetermined second resistance per unit length is adapted to form a elongated combined heating member, such that a voltage required for maintaining the predetermined current between a first end and a second end of the combined heating member is within a predetermined voltage interval for every possible length within the predetermined length interval.

The first elongated heating member and the second elongated heating member may be comprised in a heating cable or a heating foil, which is advantageous in that the heating cable or heating foil may be associated with a plurality of predetermined length intervals.

The means for generating a predetermined constant current may comprise a first means for generating a predetermined first constant current, and a second means for generating a predetermined second constant current. The means may be visually associated with combined heating members by, e.g., having the same colour, shape or symbol as a heating element, such as a heating cable, comprising the combined heating member.

An advantage of the kit of parts is that a manufacturer of heating elements, such as heating cables or heating foils, is able to provide a user with heating cables which suits a wide range of different applications, without the need to require the user to specify the required heating member length. The user can purchase a kit of parts comprising a plurality of different heating members associated with different length intervals and further comprising one or more means for generating a predetermined constant current. By choosing a suitable cable for an approximated length and providing a constant current by the means for generating a constant current, the user is ensured that the required voltage lies within a known voltage interval. The choice of heating member does not need to be done until the user is on-site instead of on beforehand. The user can thereby make the best possible approximate of the required length without having to guess and can furthermore purchase heating members for many different length intervals minimizing the risk of not being able to install the heating cable due to not having a heating cable of with the required length.

The means may comprise a plurality of current alternatives, wherein each provided current value results in a required voltage within the predetermined voltage interval. However, different currents provide different output power per unit length. Thereby, the output power and hence, the temperature of the cable may be controlled by changing the provided constant current.

Definitions

By heating member is meant a member of a conductive material. The heating member may be, e.g., a resistor wire or a semiconductor. The heating member comprises one continuous conductive path or current path. By applying a voltage between a first end and a second end of the heating member, a current flows between the first end and the second end through the continuous conductive path. The heating member is designed such that a power output generating an increase in temperature for the heating member, and thus its surroundings, is provided.

By combined heating member is meant any member provided by adapting one or more heating member(s) such that a continuous conductive path or current path through the one or more heating member(s) is achieved. Thus, a heating member may be part of a combined heating member. For example, two heating members, i.e. conductors, comprised in a heating cable could be electrically connected to each other in one end of the heating cable such that a combined heating member is provided. Further, a combined heating member may comprise a single heating member e.g. in the form of the conductor of a single conductor cable. Similarly, a combined heating member may comprise a plurality of heating members, e.g. comprised in a single or a plurality of heating cables or the like.

Hence, the skilled person will understand that a combined heating member can be provided by simply adapting only one heating member by for example shorten the heating member length. Analogously, the skilled person will also understand that a heating cable comprising several conductors or heating members may be adapted in various ways to end up with a number of combined heating member configurations, as disclosed herein.

By constant current is meant a current having a constant mean current over a certain period of time. This means that the actual current may fluctuate over short periods of time, where the short periods of time are of the magnitude that no significant temperature changes occurs to the heating member, combined heating member or object being heated. In other words, the thermal inertia of the heating member or combined heating member and its surroundings brings about that no significant temperature changes occur to the heating member or combined heating member, although the current may not be constant over a short period of time. To put it differently, the root mean square value of the constant current shall be constant.

Hence, the skilled person will understand that a constant current, i.e. a current having a constant mean current over a certain period of time, may be provided in many different ways. For instance, an alternating current may be used, such as an alternating current having a sine wave form, a triangular wave form, a square wave form or similar. Further, it is also possible to alter an existing alternating current such as a mains current alternating according to a sine wave form. The constant current may for instance be controlled by repeatedly feeding a specific number of periods of a sine wave or similar to the heating member or combined heating member and subsequently reset the voltage for a specific period of time such that no current flows during the latter period of time. By these measures the mean current may be controlled and its mean value kept constant. It is also possible to control the constant current by resetting the voltage at a certain level of a sine wave such that only a portion of the initial wave is fed to the heating member or combined heating member. Further, the constant current may be controlled by repeatedly resetting a direct voltage for a specific period of time. Furthermore, the skilled person will understand that any current having any wave form may be controlled by altering the shape or characteristics of the wave form such that a desired constant current is achieved.

BRIEF DESCRIPTION OF DRAWINGS

These and other aspects of the invention will now be described in more detail, with reference to the appended drawings showing currently preferred embodiments of the invention, wherein.

DETAILED DESCRIPTION

Figure 1:
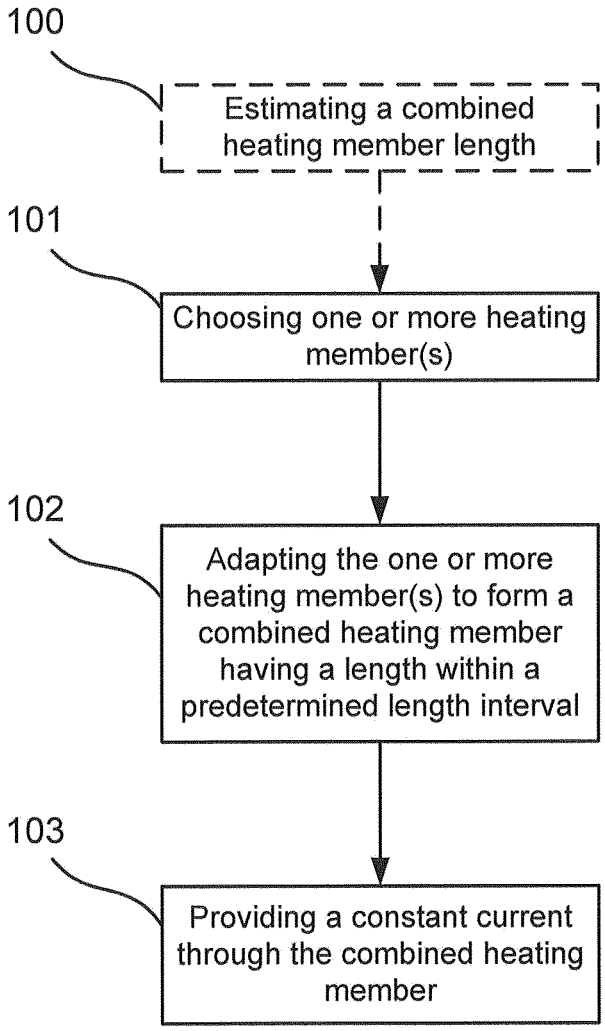
FIG. 1 illustrates a method according to the present invention.

FIG. 1 illustrates a method for heating an object according to a preferred embodiment of the present invention.

One or more elongated heating member(s), comprised in for example one or more heating cable(s), is/are chosen according to a step 101. The one or more heating member(s) has/have a predetermined resistance per unit length.

The one or more heating member(s) is/are adapted to form a combined heating member with a length within a predetermined length interval, according to a step 102. The length interval is associated with the resistance per unit length of the chosen one or more heating member(s). Next, the heating member is arranged by the object to be heated.

A constant current is provided through the combined heating member according to a step 103. The current is provided such that it flows between two ends of the combined heating member, resulting in an output power and consequently a temperature increase of the combined heating member. Since the provided current is constant, the resulting output power per unit length is also constant as the resistance per unit length is constant. The output power can be calculated by $P=R\cdot I^2$ wherein P is the power, R is the resistance and I is the current.

The adaption of the one or more heating member(s) may be achieved by, e.g., cutting at least one of the heating members or electrically connecting a plurality of heating members with each other.

The predetermined length interval indicates within which length the combined heating member is designed to operate for a predetermined constant current, i.e. within which voltage interval the required voltage needs to be in order to maintain the constant current. A smaller range of the length interval provides a smaller range of the voltage interval. A well-devised voltage interval provides for an arrangement without the need for transforming voltage up or down to the required voltage levels from, e.g., a mains voltage or any other available voltage source.

It will be appreciated that the length of the combined heating member does not necessarily equal the length of the heating element, such as a heating cable, comprising the combined heating member. For example, a parallel two conductor heating cable where the conductors are cut to a length and short circuited in one end by connecting the two conductors. Thereby, the current path of the heating cable is twice the length of the cable.

In similar, a heating cable comprising a plurality of heating members can be short circuited by all or some of its heating members in one or two ends, thereby creating a current path with a different length than the length of the heating cable. As understood by the person skilled in the art, there are many ways to arrange the current path by connecting heating members comprised in a heating element.

It should be understood that applied voltages and currents are not limited to any of AC or DC. As will be described in connection to FIG. 3, the combined heating member can be designed in many different ways.

In one embodiment, the method comprises a further step 100 of estimating a combined heating member length required for a specific application. The choice of the one or more heating member(s) in step 101 can then be based on the estimated heating cable length, such that the one or more heating member(s) associated with a length interval wherein the estimated length lies, is chosen.

Figure 2:
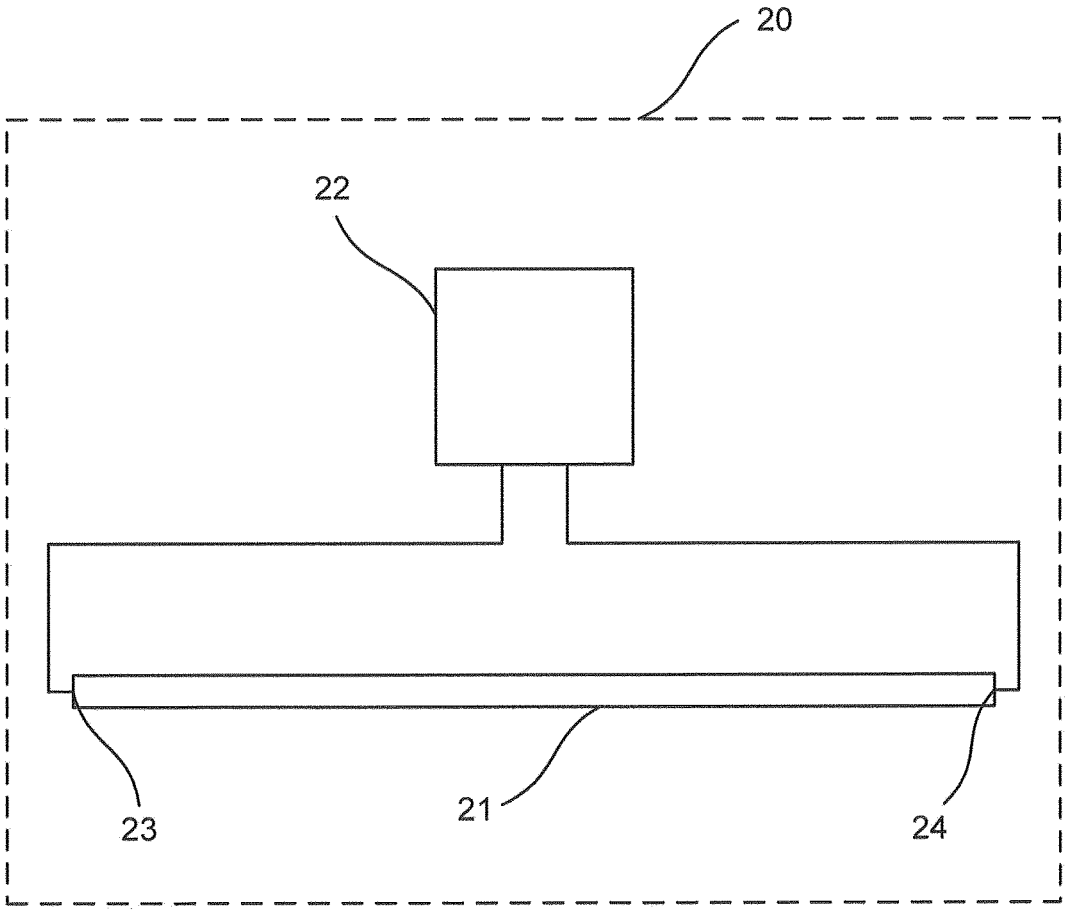
FIG. 2 illustrates a heating device according to the present invention.

FIG. 2 illustrates a heating device 20 for heating an object. The heating device comprises a combined heating member 21 which is elongated. The combined heating member 21 forms a conducting part of a heating cable. The combined heating member 21 has a particular length within a length interval associated with a resistance per unit length of the combined heating member 21.

By associated is meant that the combined heating member 21 is physically designed to operate within the predetermined length interval given a certain current, such that a resulting voltage is kept within a predetermined voltage interval. In some embodiments, the predetermined voltage interval is chosen such that the interval is suitable for a provided voltage, such as the mains voltage. Thereby, the provided voltage, such that the mains voltage, does not need to be transformed. Common mains voltage levels include 230V, 400V, 110V, etc.

As disclosed herein above different heating members may be provided, which are associated to operate within various predetermined length intervals given a certain current. According to embodiments of the invention, the intervals may be 0.5-50 m, 10-300 m, 40-1000 m, 100-3000 m, 300-10000 m or 800-20000 m.

The device further comprises means 22 for generating a predetermined constant current. By predetermined is meant that the current is chosen to a specific value in conjunction with the resistance per unit length of the combined heating member 21, such that the resulting voltage, according to Ohm's law, lies within a predetermined voltage interval when the combined heating member 21 has a length within its associated length interval.

The means 22 is connected to a first end 23 and a second end 24 of the combined heating member 21. The connection is arranged such that when a current is applied, the current flows between the first end 23 and the second end 24.

Depending on application, the current is chosen to be alternating current (AC) or direct current (DC). Any type of AC can be used. It will be appreciated that the orientation of the first end 23 and second end 24 is not limited to the illustrated example, i.e. the second end 24 can equally as well be the first end 23 and vice versa.

The combined heating member 22 is advantageously comprised in a heating cable, in particular a series resistive heating cable. General series resistive heating elements comprising the combined heating member 21 are in general a preferred embodiment.

The combined heating member 21 comprises preferably a material chosen from a group consisting of aluminium, iron, nickel, chrome, cobalt, manganese, zinc, copper, tin, and silicon or an alloy thereof. Advantageous alloys include invar, FeCrAl, constantan, stainless steel, CuNi, NiCr and brass.

In some embodiment, it is preferred that the combined heating member 21 has a resistivity within an interval 0.0172-1.39 $\Omega mm^2/m$.

In some embodiments, the one or more heating member(s) are designed to be cut. For example, the one or more heating member(s) could be surrounded by a external covering or isolation of a flexible material such that it is easily cut. A resulting advantage is that the one or more heating member(s) can be easily adapted to form a combined heating member 21 for a specific application on-site. In other embodiments, a single heating member is designed to be cut to a length within the predetermined interval, thus forming a combined heating member 21.

In a further embodiment, a chosen heating member is adapted to form a combined heating member 21 by simply cutting the heating member into a length within the associated predetermined length interval. A manufacturer does thereby not need to custom-made the heating member for a specific pre-defined application but could instead provide a heating member designed to be adapted, by "cut-to-length" on site, to form a combined heating member 21. A further advantage is that the user does not need to estimate on beforehand which length of a, e.g., series resistive heating cable that is required for the specific application before having been on-site and having seen the conditions. With known technique a user must often provide manufacturer with such an estimation in order to purchase, e.g., a series resistive heating cable. Hence, by the present invention a heating cable may be provided in a more time and cost-efficient way. Of course, these advantages also applies to other types of heating elements comprising heating member(s).

In some embodiments, where the means 22 for generating a current comprises a thyristor, a lower limit within the voltage interval is defined as the level at least needed for the thyristor to conduct a current. The lower limit could of course alternatively be determined by any other component within the device.

The higher limit of the predetermined voltage interval could be defined such that the voltage never reaches values where the security is questioned. In one embodiment, the voltage interval is adapted to the provided mains voltage. An advantage of this definition is that the provided power mains does not need to be transformed before being applied to the combined heating member. Different countries/regions have different standard mains voltage levels. Examples of standard voltage mains levels are 100V (in for example Japan), 110V (in for example Taiwan), 120V (in for example USA), 220V (in for example Russia and Chine), 230V (in for example Norway and Great Britain), 240V (in for example Cyprus). Other voltage levels could also be of interest, such as for example 400V, in embodiments with, e.g., a three phase AC.

In these preferred embodiments, it is advantageous to define the predetermined voltage interval with a lower limit voltage, which is about 4% of the mains voltage, and a higher limit of the specifically provided mains voltage level. Examples of such intervals are 8V-230V, 15V-400V, 5V-110V, 40V-1000V.

In some embodiments, the means 22 is arranged to provide a plurality of predetermined constant currents. It should be appreciated that in such embodiments, each predetermined current is chosen in conjunction with the resistance per unit length of the combined heating member 21, such that the resulting voltage lies within a predetermined voltage interval. Different currents provides different output power per unit length and thus, resulting in different temperatures of the combined heating member and its surrounding. Hence, the heating temperature can be altered by changing the provided current by the means 22.

Correspondingly, it is possible to alter the generated power per unit length for a particular application, using a predetermined current and having a specific length of the combined heating member 21, by choosing an elongated heating member having a specific resistance per unit length. This means in turn that a specific elongated heating member having specific resistance per unit length may be chosen in order to generate a specific power per unit length for a specific application. In other words, the elongated heating member or members may be chosen depending on the power requirements of a particular application. Hence, the heating temperature can be altered by choosing an elongated heating member having a specific resistance per unit length for a particular application.

The arrangement of the combined heating member by the object to be heated is adapted to the particular object. For example, if the object is a water pipe, a heating cable can be arranged around, along and/or inside the water pipe. If the object is less structural, such as snow on a roof, a heating cable can be arranged in, e.g., a pattern in connection to the roof such that it heats an area, covered by snow, when a constant current is applied.

Advantageously, the length intervals for a plurality of different combined heating members are at most partly overlapping. In some embodiments, it can on the other hand be advantageous if the length intervals do not overlap at all.

In embodiments where a plurality of combined heating members are comprised in a heating element (such as a heating cable), a particular advantage of providing a constant current though the combined heating members is that a short circuit between the combined heating members does not result in an increased power per unit length since the power per unit length is kept constant for any combined heating member length. Thus, the security risk of dangerously high power output is lowered.

The current could be provided by direct connection between the ends of the combined heating member to means for generating the current. However, in most embodiments the current is provided by an indirect connection. The indirect connection commonly comprises low-resistive components, typically a cable with copper conductors such as a connection cable. The resistance of the indirect connection is thereby negligible in comparison to the total resistance of the combined heating member.

In embodiments where elements with non-negligible resistances are connected in series or parallel with the combined heating member, their resistances often need to be considered when choosing one or more heating member(s). In such an embodiment, it is still true that the voltage for the combined heating member alone, with a length within a predetermined length interval, is within a predetermined voltage interval for a predetermined constant current. The total required voltage for the entire arrangement is however higher than the required voltage for the combined heating member alone. Thus, it cannot be guaranteed that the total required voltage lies within the predetermined voltage interval. The skilled person realizes that the one or more heating member(s) can be chosen and adapted to a combined heating member such that it is compensated for the increased total resistance and consequently such that the total required voltage lies within the predetermined voltage interval for the predetermined constant current. Thus, even in these types of embodiments where the user needs to take the added components into consideration, the present invention provides a more flexible method for arranging a combined heating member when compared to known techniques.

As the skilled person realizes, some arrangements could have an extra resistance of the arrangement, besides the resistance of the combined heating member, causing the required voltage for the arrangement for a specific constant current to become higher than the upper level of the predetermined voltage interval. Such an arrangement is for example if the voltage interval is 50V-240V and the extra resistance requires a voltage of 300V for maintaining the constant current. The total required voltage may thereby not come under 300V by choosing a combined heating member of a lower resistance. It is realized by the skilled person that other measures however may be taken, such as lowering the constant current such that the required voltage consequently is lowered.

Figure 3A:
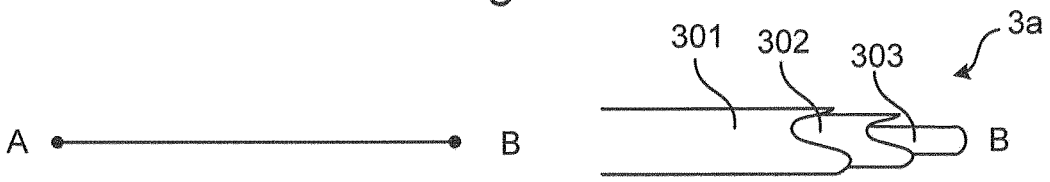
FIG. 3*a-d* illustrate different embodiments comprising heating members.
Figure 3B:
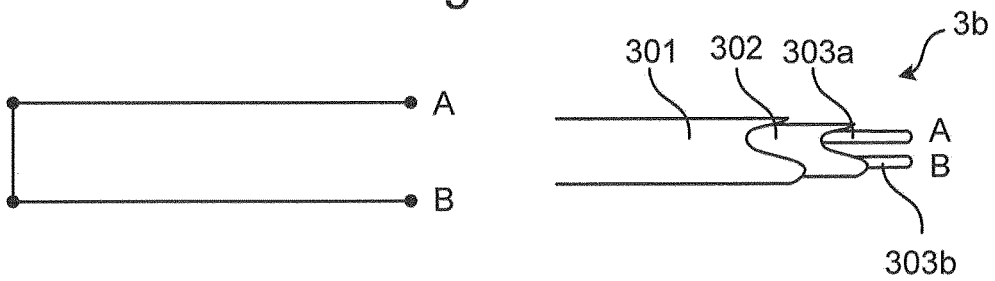
Figure 3C:
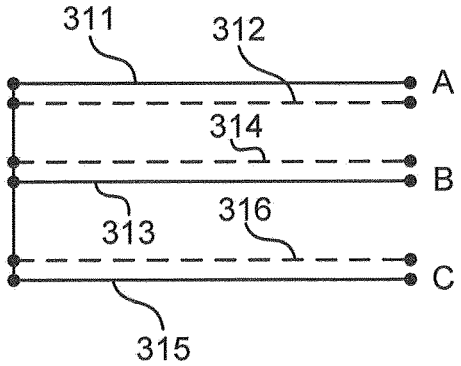

FIG. 3*a-c* illustrate embodiments comprising a combined heating member 21, wherein the combined heating member is comprised in a heating cable.

In FIG. 3*a* a heating cable, generally given by reference 3*a*, comprising a combined heating member 303 is shown on the right. Its corresponding circuit diagram is shown on the left side of FIG. 3*a*. The heating cable 3*a* further comprises a screening member 302, an external member 301 and an isolating member (not shown). The screening member may comprise metal wires, a metal foil or a metal band.

The combined heating member 303 is designed with a resistance per unit length which in conjunction with a particular constant current results in a voltage within a predetermined voltage interval for every length of the cable within a predetermined length interval. A current is provided to the combined heating member 303 by connecting a means for generating the constant current such that is flows from one end A of the combined heating member 303 to another end B of the combined heating member 303, or vice versa. The applied current can be DC or AC of any form. For example, AC can be provided by applying an alternating sine wave voltage with an effective voltage or root mean square (r.m.s.) of 230V. Of course, the alternating voltage can have many other forms such as a square wave or triangular wave. In some embodiments, it is also advantageous to pulse the voltage such that a pulsed current is achieved. It will be appreciated that all variations of voltage and current forms for powering a combined heating member are possible in embodiments of the present invention.

By applying a constant current $I_{const}$ through the combined heating member 303, the combined heating member 303 generates an effect P which depends upon the total resistance $R_{tot}$ of the combined heating member 303 and the constant current $I_{const}$ according to $P=R_{tot}\cdot I_{cons}^2$. Since the effect P is direct proportional to the total resistance, the effect P per unit length will be constant regardless of the length of the cable.

In FIG. 3*b*, on the right, a series resistive heating cable, generally given by reference 3*b*, comprising a combined heating member formed by adapting a first heating member 303*a* and a second heating member 303*b* by electrically connecting the remote ends of them (not shown). The corresponding circuit diagram for the heating cable 3*b* is shown on the left side of FIG. 3*b*, wherein A and B represents ends of a combined heating member formed from the adaption of the heating members 303*a* and 303*b*. The heating cable 3*b* further comprises a screening member 302 and an external member 301. The heating members 303*a* and 303*b* is isolated from each other by an electrically isolating member (not shown).

The heating cable in the present embodiment is advantageous in that the ends A and B are provided in proximity with each other. This provides for a less complex installation of the heating cable in comparison to the embodiment in FIG. 3*a*. In particular, the heating cable must not be arranged in a return path to the means for generating the current and therefore a more flexible arrangement of the cable is provided. A heating cable according to FIG. 3*b* is achieved by providing a heating cable, according to step 101, comprising two parallel conductors; cutting the heating cable, according to step 102, such that the length of the heating cable lies within a predetermined length interval associated with the heating cable and in particular its resistance per unit length; and short circuit the conductors in one end of the heating cable such that the circuit corresponds to the circuit diagram on the left in FIG. 3*b*. Hence, in this embodiment, the total length of the path of the current will be approximately twice the length of the heating cable.

The person skilled in the art realized that different embodiments of a cable can be associated with different length intervals depending on how the cable is electrically arranged, i.e. how the current paths are designed by, e.g., short-circuiting two or more conductors at one end of the heating cable.

FIG. 3*c* illustrates a circuit diagram for a combined heating member according to some embodiments of the present invention. The cable comprises three heating members 311, 313 and 315 which are connected to each other by their ends. The combined heating member can be operated with, e.g., a three-phase alternating current in order to heat an object.

By adapting further heating members 312, 314 and 316, a combined heating member comprising six parallel conductors is provided. Such a combined heating member is formed by, e.g., providing a heating cable comprising six parallel heating members. In some embodiments, the cable is cut and the heating members are adapted to form a combined heating member, as shown in FIG. 3*c*, with a length of a current path which lies within a predetermined length interval associated with the heating members. A combined heating member is formed by, e.g., adapting one or more heating members comprised in a heating element such as a heating cable. Thus, all of the comprised heating members in a heating element must not be connected. For example, four non-connected heating members comprised in a heating element can be adapted such that two combined heating members is formed by connecting the heating members with each other in pairs.

Further, a plurality of elongated heating members having different resistances per unit length may be arranged within the same heating cable or external member 301. This means in other words that a single heating cable having a plurality of elongated heating members having different resistances per unit length may be provided. By providing at least three different elongated heating members or conductors having different resistances per unit length, within the same external member 301 or heating cable, it is possible to adapt the elongated heating members such that different elongated combined heating members are formed using the same heating cable. It is thus possible to connect the elongated heating members comprised in the external member 301 or heating cable such that the resulting elongated combined heating member 21 or heating members is/are associated with different predetermined length intervals of the combined heating member/members 21. This is preferably performed by connecting the elongated heating members comprised in the external member 301 or heating cable in pairs, i.e. by connecting two of the elongated heating members comprised in the external member 301 or heating cable to form an elongated combined heating member 21.

The concept of providing a plurality of heating members having different resistances per unit length in a heating cable and connecting them in pairs to form an elongated combined heating member 21 is exemplified below by describing a number of currently preferred embodiments of a heating cable.

According to a currently preferred embodiment, three elongated heating members or conductors are arranged within the same heating cable. One conductor or heating member is made of copper, meaning that the resistance of this conductor may be neglected. This does in turn mean that the copper conductor will in principle not generate any heat when a current is flowing through the conductor. Hence, the copper conductor may preferably not be seen as an elongated heating member as the heat generated by the copper conductor is very limited. The other two conductors or elongated heating members do on the other hand have resistances per unit length which results in that heat is generated when a current is flowing through the respective elongated heating members. The resistances per unit length of the two elongated heating members are different, i.e. one elongated heating member has a first resistance per unit length and one elongated heating member has a second resistance per unit length.

By using the above described heating cable it is thus possible to combine the copper conductor with the respective elongated heating members to provide combined elongated heating members 21 having different resistances per unit length. This means in practice that the same heating cable will be associated with two different length intervals given a constant current. In other words, different lengths intervals of the elongated combined heating members 21 may be used for a predetermined constant current in order to keep the voltage within a predetermined voltage interval for every length of the respective length intervals. Hence, the same heating cable will be suitable for being used in different length intervals depending on which elongated heating member is combined with the copper conductor to form a combined elongated heating member 21. The copper conductor is consequently used as a return wire or conductor having a resistance which may be neglected.

According to another currently preferred embodiment, three different elongated heating members are comprised within the same heating cable or external member 301. Two of the elongated heating members have in this particular case the same resistance per unit length, i.e. two elongated heating members have a first resistance per unit length and one elongated heating member has a second resistance per unit length. This means that the elongated heating members may be connected to form elongated combined heating members 21 in two different ways. Hence, the two elongated heating members having the first resistance per unit length may be combined or one of the elongated heating members having the first resistance per unit length may be combined with the elongated heating member having the second resistance per unit length. This arrangement does consequently bring about that same heating cable will be suitable for being used in two different length intervals depending on which elongated heating members are combined to form an elongated combined heating member 21.

According to another currently preferred embodiment, four different elongated heating members are comprised within the same heating cable or external member 301. Two of the elongated heating members have in this particular case the same resistance per unit length whereas the other two have elongated heating members have a different resistance per unit length, i.e. two elongated heating members have a first resistance per unit length and two elongated heating members have a second resistance per unit length. This means that the elongated heating members may be connected to form elongated combined heating members 21 in three different ways. Hence, two elongated heating members having the same resistance per unit length unit length may be combined, i.e. two elongated heating members having the first resistance per unit length unit length may be combined or two elongated heating members having the second resistance per unit length unit length may be combined. Additionally an elongated heating member having the first resistance per unit length may be combined with an elongated heating member having the second resistance per unit length. This arrangement does consequently bring about that same heating cable will be suitable for being used in three different length intervals depending on which elongated heating members are combined to form an elongated combined heating member 21.

According to another currently preferred embodiment, six different elongated heating members are comprised within the same heating cable or external member 301. In this particular case, two elongated heating members have a first resistance per unit length, two elongated heating members have a second resistance per unit length and two elongated heating members have a third resistance per unit length. This means that the elongated heating members may be connected to form elongated combined heating members 21 in six different ways. Hence, two elongated heating members having the same resistance per unit length unit length may be combined, i.e. two elongated heating members having the first resistance per unit length unit length may be combined, two elongated heating members having the second resistance per unit length unit length may be combined or two elongated heating members having the third resistance per unit length unit length may be combined. Additionally an elongated heating member having the first resistance per unit length may be combined with an elongated heating member having the second resistance per unit length or the third resistance per unit length. In addition to this, an elongated heating member having the second resistance per unit length may be combined with an elongated heating member having the third resistance per unit length. This arrangement does consequently bring about that same heating cable will be suitable for being used in six different length intervals depending on which elongated heating members are combined to form an elongated combined heating member 21.

Similarly, a plurality of heating members having different resistances per unit length may be arranged in a single heating foil.

Figure 3D:
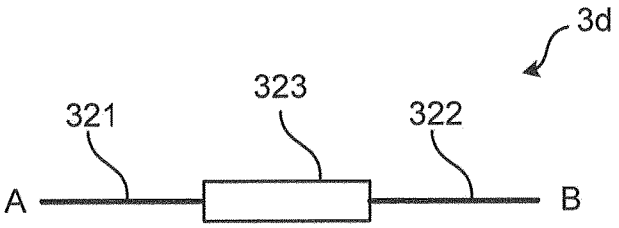

FIG. 3*d* illustrates a heating arrangement, generally given by reference 3*d*, where heating is provided to an object by a combined heating member. Combined heating members 321 and 323 and a heating element 323 are arranged in series such that a provided constant current can flow between an end A and an end B.

In some embodiments, the combined heating members 321 and 322 are comprised in heating cables. The heating element 323 can be, e.g., a heating plate or a lamp or any other heating component. The member 323 could instead be a substantially non-heating element.

It will be appreciated by the skilled person that the kind of composite arrangement illustrated in FIG. 3*d*, results in a higher total resistance for the whole arrangement than for any of the combined heating members 321 and 322 alone. Thus, the required total voltage level for the predetermined constant current will possible lie outside the predetermined voltage interval. The skilled person realizes that another one or more heating member(s) can be chosen and adapted to a combined heating member in order to compensate for the increased total resistance such that the total required voltage lies within the predetermined voltage interval for the predetermined constant current.

In the embodiment of FIG. 3*d*, the one or more heating member(s) adapted to form the combined heating member 321 is/are chosen based on the knowledge that it is going to be connected to the combined heating element 322 and heating element 323. In order to keep the required total voltage within a predetermined voltage interval, the combined heating member 321 must have a lower resistance than if it were not connected to the other components. How much shorter the combined heating member 321 can is easily calculated by Ohm's law by for example knowing the resistances of the heating element 323 and the combined heating member 322.

It will further be appreciated by the skilled person that there exists arrangements where a shortening of the combined heating member 321 cannot compensate such that the total required voltage lies within the predetermined voltage interval. This is true when the required voltage required for all components, besides the combined heating member 321 in the arrangement, is above the upper limit of the predetermined voltage interval. The compensation could in such arrangements then be achieved by lowering the constant current level, as realized by the skilled person.

By arranging the heating member 321 in series with the element 323 and heating member 322, the total resistance of the circuit is not only provided by the heating member 321. It is realized by the person skilled in the art in this and other corresponding arrangements, that the resistance of the circuit provided by other parts than the present heating member 321 affects the total required voltage for the whole arrangement.

Figure 4:
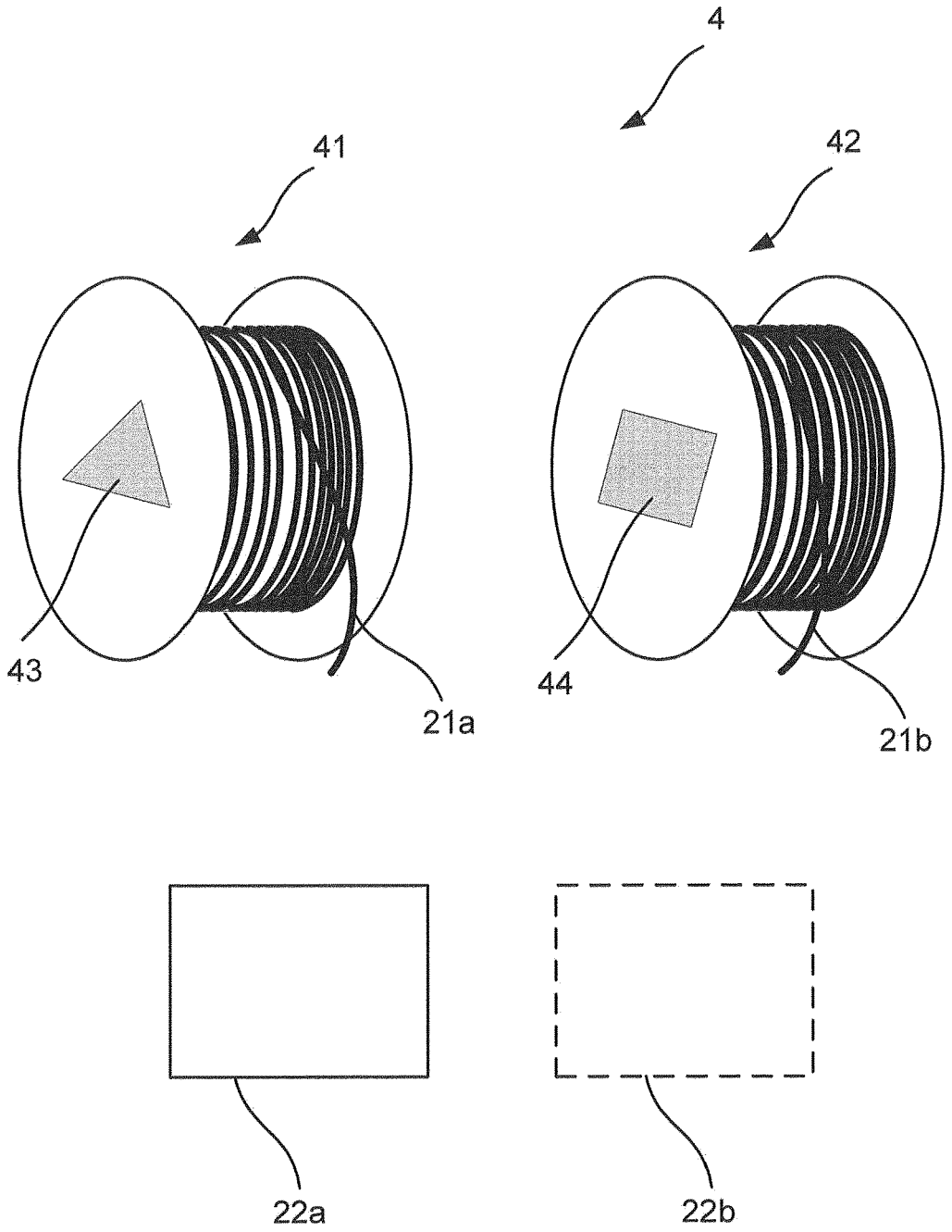
FIG. 4 illustrates a kit of parts according to the present invention.

FIG. 4 illustrates a kit of parts 4 according to an embodiment of the present invention. The kit of parts comprises two elongated heating member rolls 41 and 42. The roll 41 comprises a heating cable 21*a* and the roll 42 comprises a heating cable 21*b*. The kit of parts further comprises a means for generating a predetermined constant current, such as a constant current control means.

Each of the heating cables 21*a* and 21*b* comprises one or more heating member(s) having a specific resistance per unit length which is associated with a predetermined length interval.

The one or more heating member(s) in heating cable 21*a* has/have a resistance per unit length which differs from the corresponding value of the one or more heating member(s) in heating cable 21*b*. The heating cables can also differ in their designs by comprising different numbers of heating members. However, as described above, a plurality of heating members having different resistances per unit length may be provided in a single heating cable 21*a*, 21*b*. The heating cables 21*a* and 21*b* can furthermore differ in visual appearance in that, e.g., their external members have different color and/or pattern. Thereby, a user can easily differentiate the heating cables 21*a* and 21*b* from each other.

The rolls 41 and 42 are associated with different characteristics in order to easy distinguish them from each other. The roll 41 comprises a triangular symbol 43 and the roll 42 comprises a square symbol 44. The symbols 43 and 44 indicate to a user which predetermined length interval the combined heating members, formed by adapting the one or more heating members comprised in the heating cables 21*a* and 21*b*, are associated with and thus intended to operate within.

In one example, the triangle symbol 43 indicates a length interval of 50-200 meters, and the square symbol 44 indicates a length interval of 150-500 meters. Before an installation on site, the user approximates how long combined heating member the installation requires. Based on this, the user chooses a heating cable associated with a length interval which the approximated length lies within. If the approximated length is, e.g., 75 meters, the heating cable 21*a* is chosen (for the roll 41 with the triangle symbol 43). If the approximated length is, e.g., 450 meters, the heating cable 21*b* is chosen (from the roll 42 with the square symbol 44). If the approximated length is, e.g., 180 meters, any of the heating cables 21*a* and 21*b* can be chosen since their both associated length intervals covers 180 meters.

It is appreciated by the skilled person that the rolls equally as well can be marked with other than symbols, such as for example letters or digits indicating the length interval. Furthermore, the length interval specified on or associated with a symbol on the roll, and consequently the heating cable, can be another length interval than the predetermined length interval associated with the heating member and its resistance per unit length. For example, a roll comprising a heating cable comprising two parallel heating members can be marked with a length interval indicating which length the heating cable should be cut to, provided that the heating members are adapted to form a combined heating member by connecting two ends of the heating members together at one end of the cut heating cable. Consequently, a roll can be marked/associated with a plurality of different length intervals.

The means 22*a* for providing a constant current is formed for providing a constant current to any of the heating cables 21*a* and 21*b* or exclusively for any of them. In order to illustrate the association between the means 22*a* and a particular heating cable, the means 22*a* can have the same color as the heating cable. For example, a user choosing a heating cable 21*a* with a blue color also chooses a means 22*a* with a blue color for providing the constant current through the combined heating member of the heating cable 21*a*. The means 22*a* is arranged such that the provided constant current through the combined heating member of the heating cable 21*a*, which combined heating member has a length within the predetermined length interval associated with the combined heating member, results in a required voltage within a predetermined voltage interval.

In one embodiment, the predetermined voltage interval is specific for a country or region in which the kit of parts is provided. In the USA, where the mains voltage are 120V, a predetermined voltage interval can be an interval just below 120V, such as 5V-120V. Such a voltage interval provides for a simple installation since the mains voltage does not need to be transformed into any higher levels.

In one embodiment, the symbols 43 and 44 are associated with the predetermined voltage interval for the combined heating member of the heating cable 21*a*, which is required to maintain the predetermined constant current provided by the means 22*a* associated with the combined heating member of the heating cable 21*a*.

A manufacturer of heating elements, such as heating cables, can by the disclosed kit of parts provide a user with the choice of heating cables which suits a wide range of different applications, without the need to require the user to specify the required heating member length. The user could purchase a kit of parts comprising a plurality of different heating members associated with different length intervals and further comprising one or more means for generating a predetermined constant current. By choosing a suitable cable for an approximated length and providing a constant current by the means for generating a constant current, the user is ensured that the required voltage lies within a desired voltage interval.

In one embodiment, the means 22 is adapted to provide a plurality of predetermined constant currents, wherein each provided constant current value results in a required voltage within the predetermined voltage interval. However, different currents provides different output power per unit length. Thereby, the output power and hence, the temperature of the cable can be controlled by changing the provided constant current.

In a further embodiment, the rolls 41 and 42 are marked with both a predetermined length interval in which the cable/combined heating member is intended to have and which current and/or power alternatives which are provided with its associated means 22.

In one embodiment, the kit of parts comprises a further means 22*b* for generating a constant current. The means 22*a* and 22*b* are associated with different combined heating members of different heating cables. The means 22*a* could be designed for use together with the heating cable 21*a* and the means 22*b* could correspondingly be designed for use together with the heating cable 21*b*.

Figure 5:
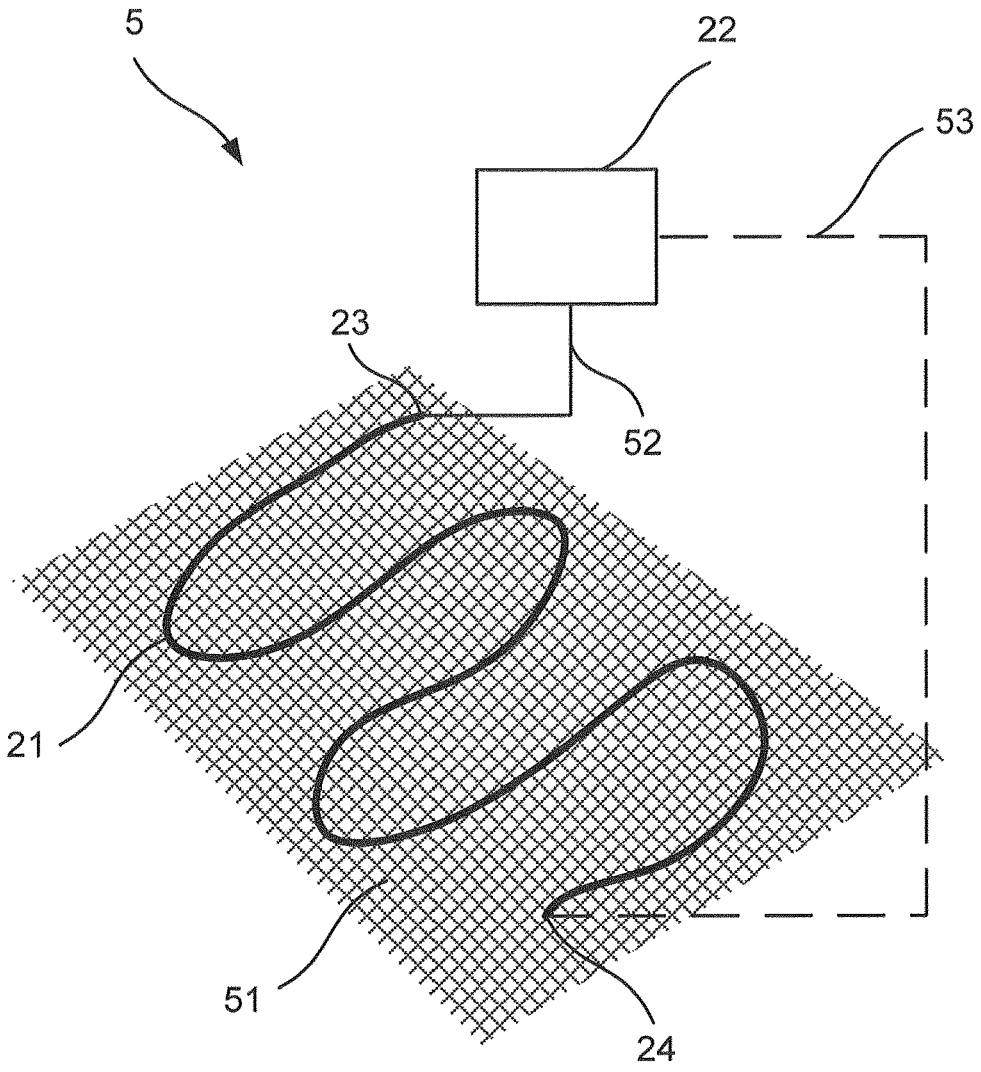
FIG. 5 illustrates a heating cable mat according to the present invention.

FIG. 5 illustrates a heating cable mat, generally given by 5, according to one embodiment of the present invention. The heating cable mat comprises a heating cable 21 arranged on a mat 51. The heating cable 21 comprises a combined heating member according to the present invention. The heating cable 21 is arranged in a pattern on the mat 51. Preferably the heating cable 21 is arranged in a symmetrical pattern. The mat 51 is of a flexible material.

A means 22 for generating a constant current is arranged in connection to at least a first end 23 of the heating cable 21. By providing a constant current to the combined heating member of the heating cable 21, the combined heating member generates a constant power per unit length and consequently, a constant power per unit area.

Depending on the form of the combined heating member, the means can be connected at one end 23 of the heating cable by a connection 52 or furthermore at another end 24 of the heating cable by the connection 53.

If the combined heating member is formed from two heating members, such as for example two conductors, which are connected, i.e. short circuited, in one end 24, thereby providing one current path twice as long as the heating cable 21, the means 22 can be connected at one end 23 of the heating cable. If the combined heating member of the heating cable 21 is formed such that the ends of the combined heating member are at different ends of the heating cable 21, the current must be provided by connecting the means 22 at both ends 23 and 24 of the heating cable. The person skilled in the art realizes that these examples can be varied in many different ways and still be enclosed in the scope of the present invention.

Further, the skilled person realizes that that a kit of parts comprising a plurality of heating mats 5 and at least one means 22 for generating a constant current may be provided. Similarly to what has been disclosed above, the kit of parts may comprise a plurality of heating mats 5 comprising heating members 21 having different resistance per unit length.

It is also possible to fabricate and/or execute other embodiments of the invention. For example, there exist many variations of heating member embodiments in addition to the examples disclosed herein. Variations of the method may comprise further steps of determining a required length of a specific arrangement or installation.

The person skilled in the art realizes that the present invention by no means is limited to the preferred embodiments described above, which also is clarified with examples of alternatives in the descriptions above.

In summary, the present invention discloses a method for heating an object, where the method comprises the steps of: choosing one or more elongated heating member or members; adapting said one or more elongated heating member or members to form an elongated combined heating member having a length within a predetermined length interval; and providing a predetermined constant current through said elongated combined heating member by connecting a means for generating a constant current to a first end and a second end of said elongated combined heating member, such that said combined heating member generating a power per unit length when said constant current flowing through said combined heating member between said first end and said second end.

The present invention further discloses a device for heating an object and a kit of parts for assembling such a heating device.

The invention claimed is:

1. A method for heating an object, said method comprising the steps of:

choosing two or more elongated heating members, said two or more elongated heating members having a predetermined resistance per unit length;

adapting said two or more elongated heating members by connecting the two or more elongated heating members in series to form an elongated combined heating member having a length within a predetermined length interval, wherein said predetermined length interval is dependent upon the choice of the two or more elongated heating members; and providing a predetermined constant current through said elongated combined heating member by connecting a means for generating a constant current, including a thyristor, to a first end and a second end of said elongated combined heating member, such that said elongated combined heating member generating a power per unit length when said constant current flowing through said combined heating member between said first end and said second end;

wherein said two or more elongated heating members having said predetermined resistance per unit length are chosen such that a voltage required for maintaining said predetermined constant current is within a predetermined voltage range for every possible length of said elongated combined heating member within said predetermined length interval.

2. The method according to claim 1, wherein said two or more elongated heating members being comprised in a heating cable or a heating foil.

3. The method according to claim 1, wherein a plurality of elongated heating members having different resistances per unit length are comprised in a heating cable or a heating foil.

4. The method according to claim 1, wherein said heating member being a series resistive heating member.

5. The method according to claim 1, wherein said elongated combined heating member comprises a material chosen from the group consisting of: aluminium, iron, nickel, chrome, cobalt, manganese, zinc, copper, tin, and silicon.

6. The method according to claim 1, wherein said elongated combined heating member having a resistivity within 0.0172-1.39 $\Omega mm^2/m$.

7. The method according to claim 1, wherein said predetermined length interval has a range in the interval of 50-500 meters, in particular 100-300 meters.

8. The method according to claim 1, wherein said predetermined voltage range being selected from the group consisting of: 8-230V, 15-400V, 5-110V, and 40-1000V.

9. The method according to claim 1, wherein said predetermined resistance per unit length being within the interval of 0.0008-500 $\Omega/m$.

10. The method of claim 1, wherein a lowest limit of the predetermined voltage range is defined as a lowest voltage for the thyristor to conduct a current.

11. A device for heating an object, the device comprising:

an elongated combined heating member having a resistance per unit length and a length within a predetermined length interval, wherein said predetermined length interval is associated with the resistance per unit length; and means for generating a predetermined constant current including a thyristor, said means being connected to a first end and a second end of said elongated combined heating member, such that said elongated combined heating member is generating a power per unit length when said constant current being arranged to flow through said elongated combined heating member between said first end and said second end;

whereby said resistance per unit length being provided such that a voltage required to maintain said predetermined constant current, when said current flows through said elongated combined heating member between said first end and said second end, being within a predetermined voltage range for every length within said predetermined length interval.

12. The device according to claim 11, wherein said elongated combined heating member being comprised in a heating cable or a heating foil.

13. The device according to claim 11, wherein a plurality of heating members having different resistances per unit length are comprised in a heating cable or a heating foil.

14. The device according to claim 11, wherein said elongated combined heating member being a series resistive heating member.

15. The device according to claim 11, wherein said elongated combined heating member comprising a material chosen from a group consisting of: aluminium, iron, nickel, chrome, cobalt, manganese, zinc, copper, tin, and silicon.

16. The device according to claim 11, wherein said elongated combined heating member having a resistivity within 0.0172-1.39 $\Omega mm^2/m$.

17. The device according to claim 11, wherein said predetermined voltage range being chosen from the group consisting of 8-230V, 15-400V, 5-110V, 8-190V, and 40-1000V.

18. The device according to claim 11, wherein said predetermined resistance per unit length being within the interval of 0.0008-500 $\Omega/m$.

19. The device according to claim 11, wherein said predetermined length interval has a range in the interval of 50-500 meters, in particular 100-300 meters.

20. The device according to claim 11, wherein said elongated combined heating member being distributed on and fastened to a surface of a flexible support member, such that a heating mat is provided;

whereby said heading mat generates a power per unit area when said constant current flows through said elongated combined heating member between said first end and said second end.

21. The method of claim 11, wherein the thyristor is directly coupled to either the first end or the second end of said elongated combined heating member.

22. A kit of parts for assembling a heating device comprising:

a first elongated heating member having a predetermined first resistance per unit length adapted to a predetermined first length interval;

a second elongated heating member having a predetermined second resistance per unit length adapted to a predetermined second length interval; and means for generating a predetermined constant current including a thyristor;

whereby each of said first and said second elongated heating member with said predetermined first resistance per unit length and said predetermined second resistance per unit length is adapted to form an elongated combined heating member by connecting the first elongated heating member and the second elongated heating member in series, such that a voltage required for maintaining said predetermined current between a first end and a second end of said elongated combined heating member is within a predetermined voltage range for every possible length within said predetermined first length interval and said predetermined second length interval respectively.

23. The kit of parts according to claim 22, wherein said first elongated heating member and said second elongated heating member being comprised in a heating cable or a heating foil.

24. The kit of parts according to claim 22, wherein said means for generating a predetermined constant current comprises:

a first means for generating a predetermined first constant current; and a second means for generating a predetermined second constant current.

* * * * *